US009795210B2

(12) United States Patent
Evans

(10) Patent No.: US 9,795,210 B2
(45) Date of Patent: Oct. 24, 2017

(54) EXPANDABLE CARRY POUCH WITH VARIABLE COMPRESSION

(71) Applicant: Scott Evans, Jacksonville, NC (US)

(72) Inventor: Scott Evans, Jacksonville, NC (US)

( * ) Notice: Subject to any disclaimer, the term of this patent is extended or adjusted under 35 U.S.C. 154(b) by 0 days.

(21) Appl. No.: 15/611,922

(22) Filed: Jun. 2, 2017

(65) Prior Publication Data

US 2017/0273445 A1 Sep. 28, 2017

Related U.S. Application Data

(63) Continuation of application No. 14/881,081, filed on Oct. 12, 2015, now Pat. No. 9,668,568.

(51) Int. Cl.

| | |
|---|---|
| ***A45F 5/02*** | (2006.01) |
| ***A45F 5/00*** | (2006.01) |
| *A45C 7/00* | (2006.01) |

(52) U.S. Cl.

CPC ..... *A45F 5/02* (2013.01); *A45F 5/00* (2013.01); *A45F 5/021* (2013.01); *A45C 7/0018* (2013.01); *A45F 2200/0591* (2013.01)

(58) Field of Classification Search

CPC .... A45F 5/02; A45F 5/00; A45F 5/021; A45F 2200/0591; A45C 7/0018

See application file for complete search history.

(56) References Cited

U.S. PATENT DOCUMENTS

| | | | | |
|---|---|---|---|---|
| 3,053,005 | A * | 9/1962 | Byers | A01K 97/20 224/610 |
| 6,202,908 | B1 * | 3/2001 | Groover | F42B 39/02 224/236 |
| 6,237,820 | B1 * | 5/2001 | Saxton | A45F 3/16 215/395 |
| 6,662,986 | B2 * | 12/2003 | Lehtonen | A45F 5/02 224/222 |
| 7,845,527 | B1 * | 12/2010 | McMillan | B26B 29/02 224/232 |
| 2005/0045681 | A1 * | 3/2005 | Hancock | B60R 11/0205 224/401 |
| 2007/0017947 | A1 * | 1/2007 | Fenton | A45C 7/0063 224/650 |
| 2008/0277436 | A1 * | 11/2008 | Wilson | F41A 9/65 224/239 |
| 2016/0003598 | A1 * | 1/2016 | Gadams | F42B 39/02 206/3 |
| 2016/0209163 | A1 * | 7/2016 | VanHeusen | A45F 5/02 |

* cited by examiner

*Primary Examiner* — Corey Skurdal

(74) *Attorney, Agent, or Firm* — Christina Chamberlain; Intellectual Property Consulting LLC

(57) ABSTRACT

An expandable carry pouch defining an interior compartment sized and dimensioned to carry tactical gear, the interior compartment defined by a front wall with forward and bottom panel segments, a back wall opposed to the front wall with forward and bottom panel segments, and bottom panel. The front and back walls have a plurality of vertical and horizontal channels such that a binding device is woven through the vertical and horizontal channels to compress the front and back wall towards one another.

12 Claims, 5 Drawing Sheets

EXPANDABLE CARRY POUCH WITH VARIABLE COMPRESSION

RELATED APPLICATIONS

This application is a continuation of U.S. patent application Ser. No. 14/881,081 filed Oct. 12, 2015, which claims the benefit of Provisional Application No. 62/063,133 filed Oct. 13, 2014 and Provisional Application No. 62/190,025 filed Jul. 18, 2015. The entire contents of the above applications are hereby incorporated by reference as though fully set forth herein.

FIELD

The present invention relates to the field of devices designed for the holding of tactical gear. More specifically, the present invention relates to devices designed to retain and secure tactical gear to the person, clothing or gear of a user.

BACKGROUND

In a tactical environment or situation or training or sporting activity the need of the operator, soldier, law enforcement officer, civilian sportsman or other user to carry various gear on one's person, in support of the mission or activity is always present. As such users are continually searching for improved methods and items to carry their gear. Such improvements often include features that increase the amount of gear being carried through a more efficient use of space, modularity in using and arranging such gear specific to a user's needs and improved accessibility to said gear while maintaining a reasonable (and sometimes adjustable) level of security in carrying such items. These items include but are not limited to: rifle magazines, pistol magazines, ammunition, radios, flashlights, batons, handcuffs, flash bangs, hand grenades, batteries, scopes or other aiming devises, or any other items as may be considered useful for their task. Additionally, users seek durability in such carry pouches as their need is essential and their operating locations are often remote.

Device for the retention and securing of tactical gear are known in the prior art and generally have a pouch having an upward-oriented opening, a flap mechanism that obstructs the upward-oriented opening when the flap mechanism is engaged and closed, means for fastening the flap mechanism in a closed position and means of attachment whereby the pouch is either an integrated feature of the clothing of a user or may be otherwise attached to the clothing or accessories worn by a user. These devices are limited in that they slow down access to stored gear. While the flap keeps the gear from falling out of the pouch, it keeps the user from quickly and efficiently removing the gear from the pouch. For example, when the pouch is used to store an ammunition magazine, the flap must first be unfastened and restrained to access the magazine contained within the pouch. This causes a delay when trying to negotiate the flap mechanism, which can be the difference between life and death for a user in a combat situation.

Also known in the prior art are devices for the retention and securing of gear wherein the pouch has an upward oriented opening but no flap mechanism. In these instances, the pouch dimensions must match the dimensions of the gear to provide a tight fit for the gear by virtue of the force of friction between the interior of the pouch and the gear it contains. By tailoring the pouch to ensure a tight fit for a specific gear, the pouch lacks the ability to securely retain and store gear of varying shapes and sizes. Each pouch tends to be designed for a particular size and shape of gear and, therefore, a single user may need to acquire several of these devices in varying sizes and designs to effectively secure, store and retain a variety of gear, such as various shapes and sizes of magazine ammunition.

As such, there is a need for a pouch that that both securely holds gear of various shapes and sizes but does not hinder the user in accessing the gear by having to open and restrain a flap that covers the opening for insertion of gear.

BRIEF SUMMARY OF THE INVENTION

The present invention seeks to meet these needs by providing a novel expandable carry pouch. The expandable carry pouch of the present invention differs from those commercially available and/or described in the prior art in that the construction uses molded components to form an interior compartment and uses formed channels to guide and protect the binding device used to bind or lace together the molded components. The formed channels enhance the weave or lacing patterns available as well as allow the tension of the binding cord to be fixed or variable. The molded components can be generic or specific in shape relative to what is to be carried. Further, the pouch has a plurality of molded mounting points to allow the pouch to be completely modular with itself and an entire family of other pouches and mounting components. Finally, the present invention is smaller with a more compact design and is more efficient in its use.

Overall method of construction, materials and process used, protective features incorporated to enhance durability of the pouch and form fitting components all add to the above desired improvements in a unique combination.

DETAILED DESCRIPTION

Figure 1:
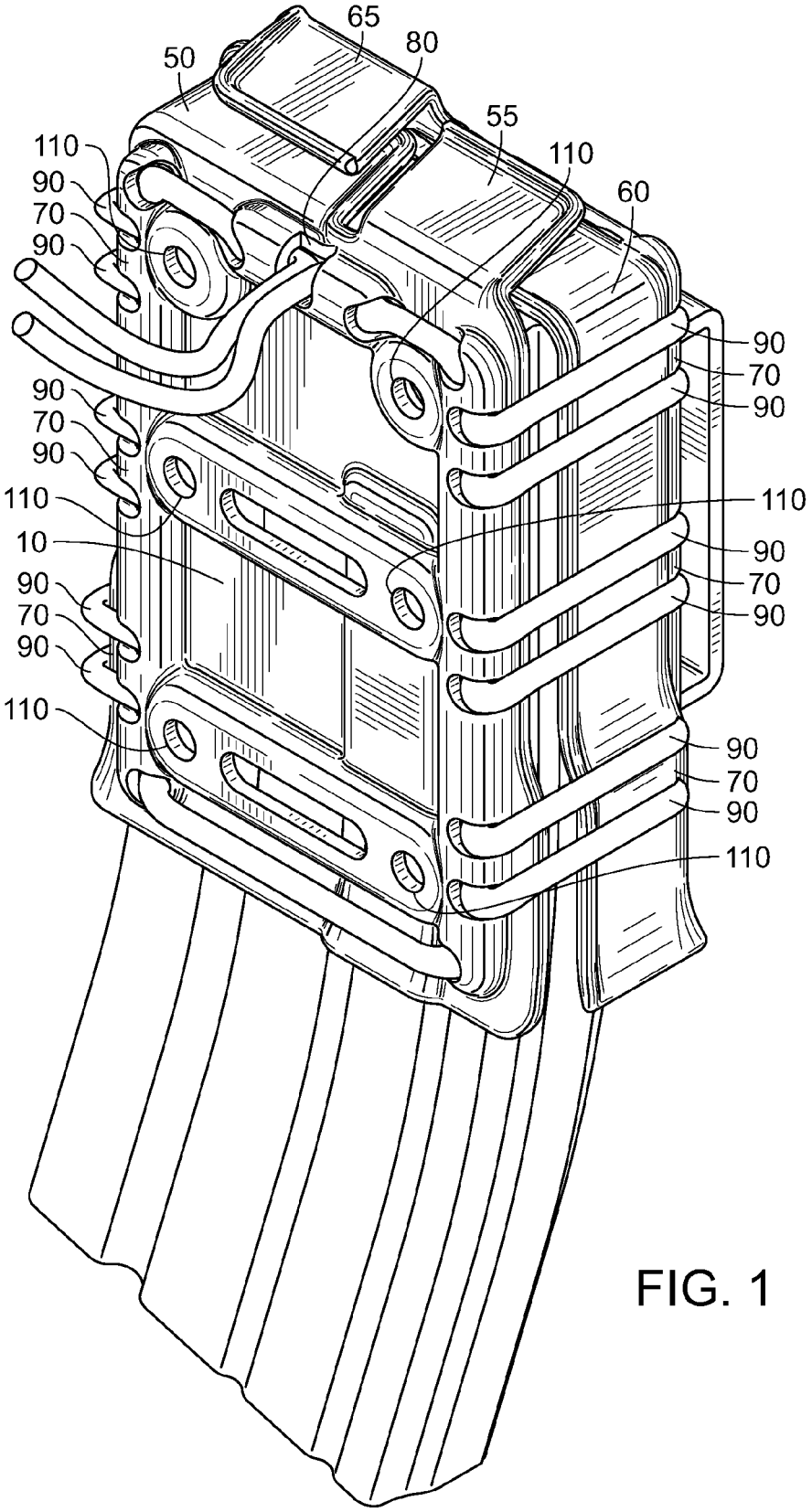
FIG. 1 is a perspective view of the expandable retention pouch of the present invention.
Figure 2:
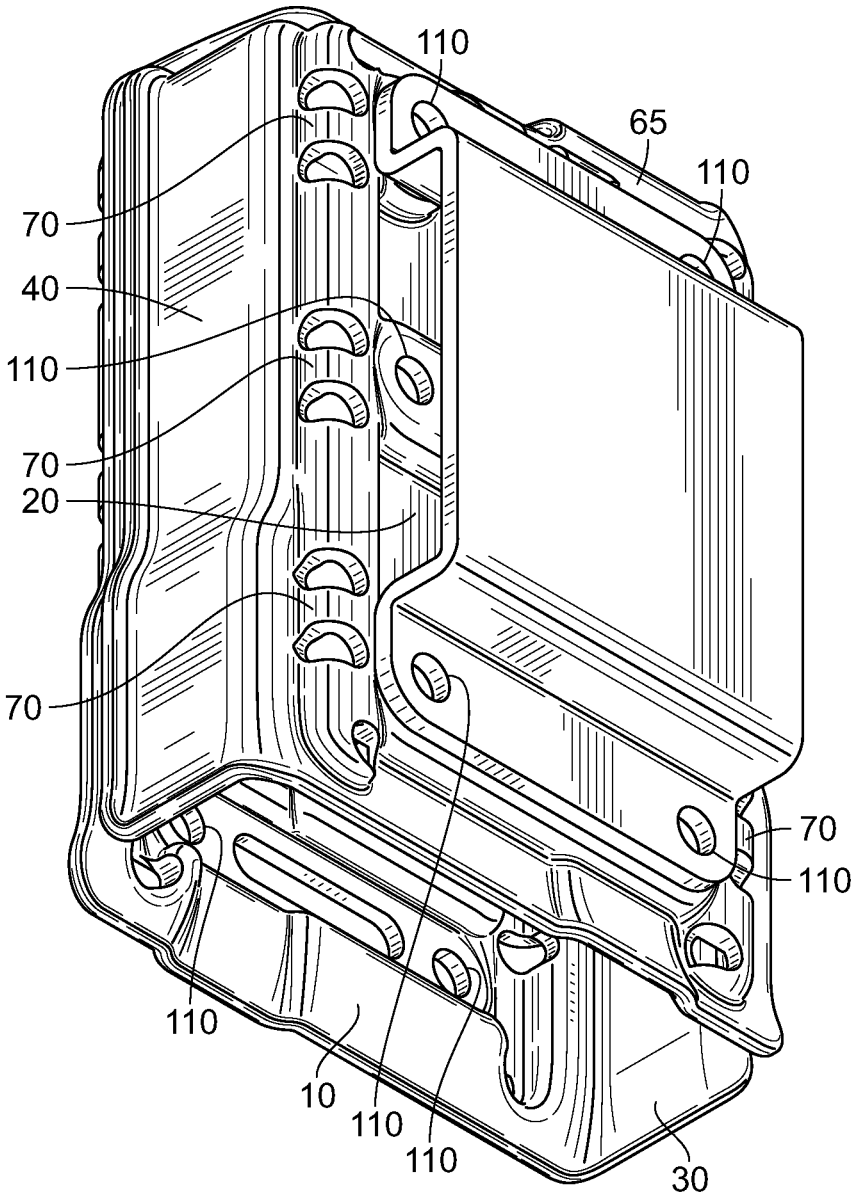
FIG. 2 is a bottom perspective view of the magazine retention device in FIG. 1.
Figure 3:
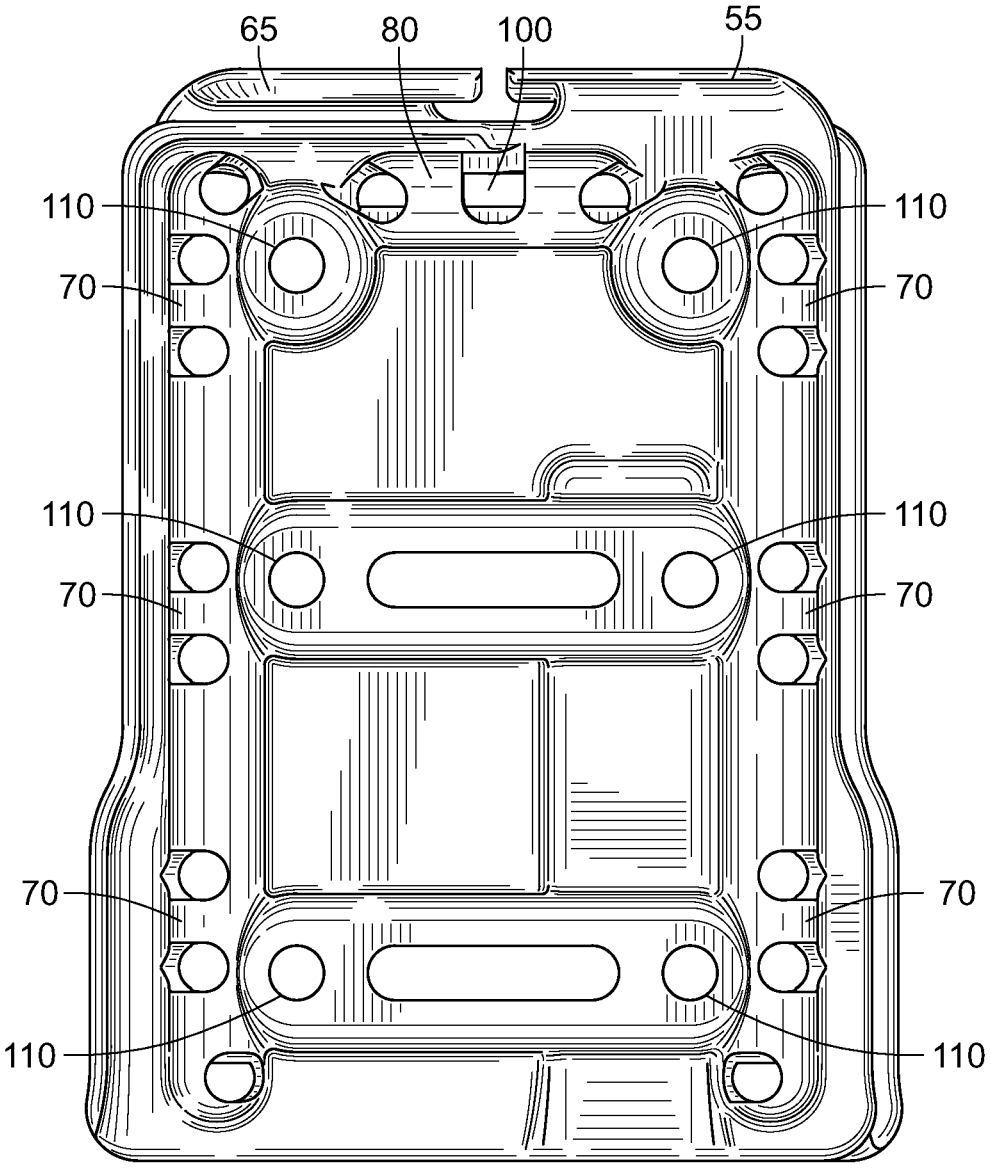
FIG. 3 is a front view of the magazine retention device in FIG. 1.
Figure 4:
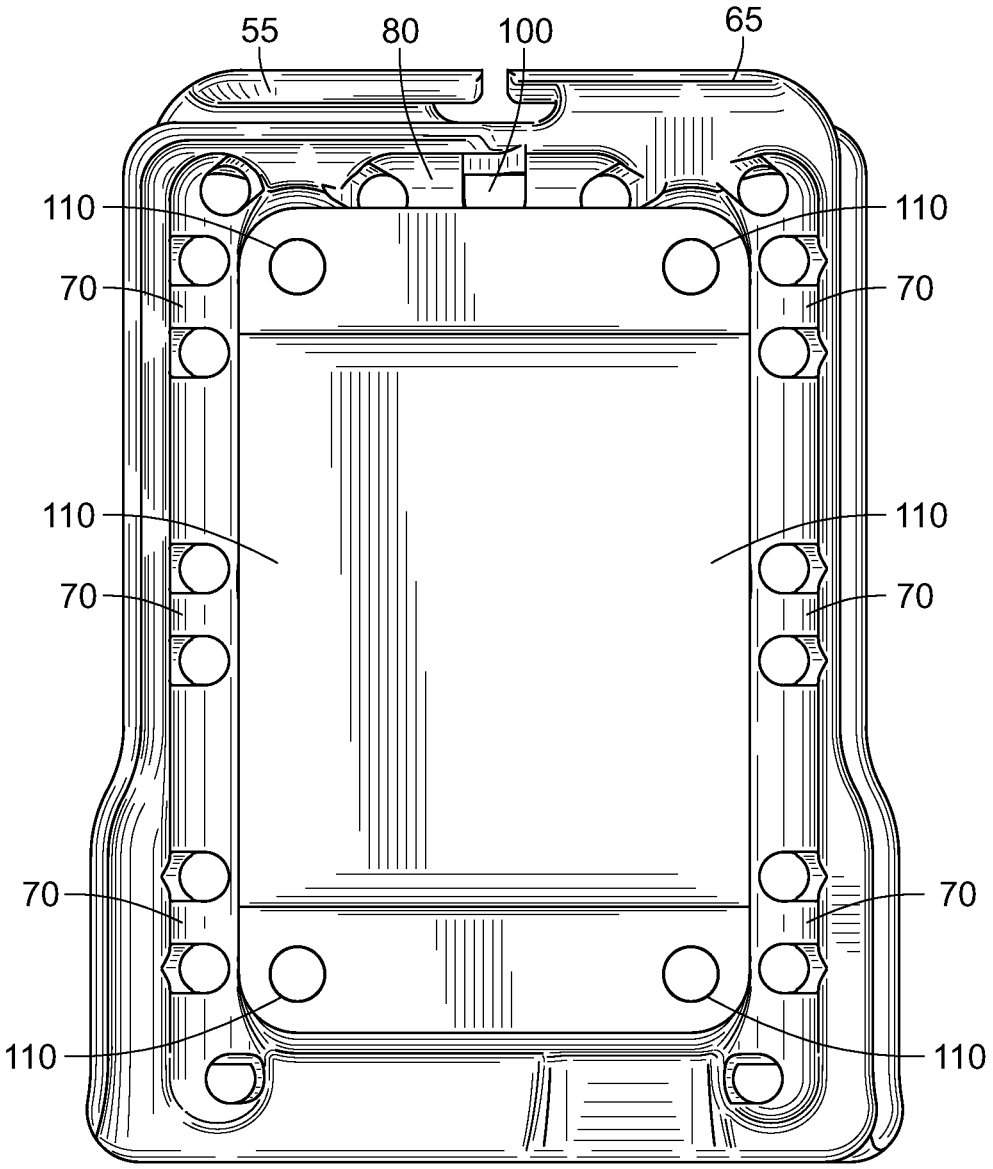
FIG. 4 is a rear view of the magazine retention device in FIG. 1.
Figure 5:
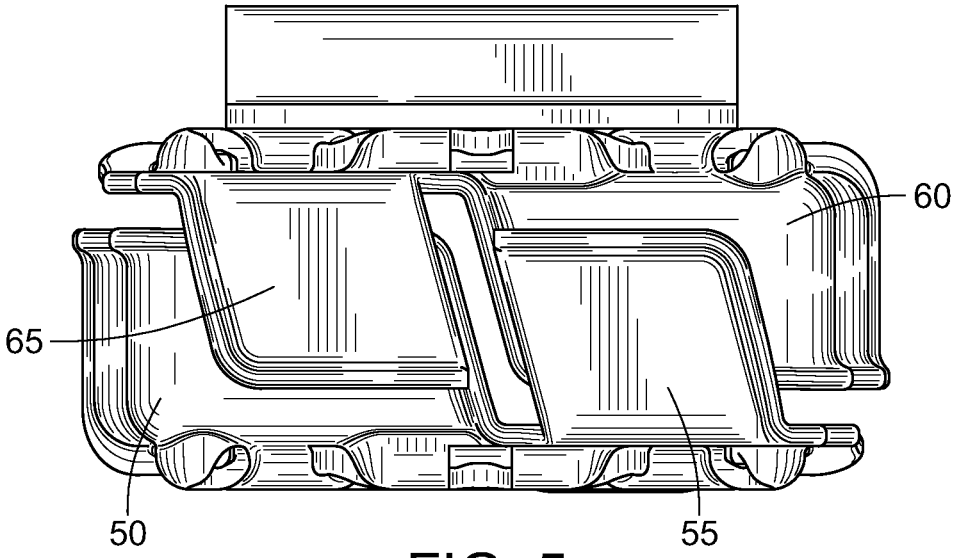
FIG. 5 is a top view of the magazine retention device in FIG. 1.

As shown generally in FIGS. 1-5, the present invention comprises an expandable carry pouch defining an interior compartment formed by a front wall 10 with a top, bottom and side edges; a back wall 20 with a top, bottom and side edges; a forward panel segment 30 extending substantially perpendicularly outward from the side edge of the front wall 10; a rearward panel segment 40 extending substantially perpendicularly outward from the side edge of the back wall 20; a front wall bottom panel segment 50 extending substantially perpendicularly outward from the bottom edge of the front wall 10; and a back wall bottom panel segment 60 extending substantially perpendicularly outward from the bottom edge of the back wall 20; a front wall bottom panel flap 55 extending substantially perpendicularly outward from the bottom edge of the front wall 20 and adjacent to the front wall bottom panel segment 50; a back wall bottom panel flap 65 extending substantially perpendicularly outward from the bottom edge of the back wall 20 and adjacent to the back wall bottom panel segment 60; the interior compartment being dimensioned for containing gear, including but not limited to: rifle magazines, pistol magazines, ammunition, radios, flashlights, batons, handcuffs, flash bangs, hand grenades, batteries, scopes or other aiming devises, or any other items as may be considered useful for their task.

The present invention further comprises at least one vertical channel 70 along the perimeter of the front wall 10 and back wall 20 and at least one horizontal channel 80 parallel to the bottom panel segments 50 and 60 and flaps 55 and 65 of the front wall 10 and back wall 20, respectively.

The front wall 10 and back wall 20 are bound or laced with one or more flexible binding devices 90 such as cord(s), tube, band, cables, etc. together such that the bottom panel segments 50 and 60 of the front wall 10 and back wall 20, respectively, are adjacent to each other and wherein flaps 55 and 65 interlock and such that the forward panel segment 30 is opposite rearward panel segment 40; wherein the binding devices are woven or laced through the plurality of vertical channels 70 and at least one horizontal channel 80 with the ends of the binding device 90 extending from a hole shown as 100 in at least one horizontal channel 80. Alternatively, the bottom panel segments 50 and 60 may extend along the length of the bottom of the front wall 10 and back wall 20 to replace flaps 55 and 65 such that the forward panel segment 30 is opposite rearward panel segment 40.

The vertical channels 70 and at least one horizontal channel 80 aid in retaining the binding device 90, enhance the correct placement of the binding device 90, enable one or more weaving or lacing patterns to be used to bind the front wall 10 and back wall 20 and offer protection to the binding device 90 from internal and external forces. Additionally, the binding device 90 can be fixed in position or adjustable so as to increase or relax the tension of the binding device 90 so as to increase or relax the compression feature of the interior compartment and the interior compartments holding power on the intended gear.

While in the preferred embodiment, the expandable carry pouch is substantially rectangular in shape when assembled, the front wall 10 and back wall 20 and the corresponding forward panel segment 30, rearward panel segment 40, front wall bottom panel 50, bottom flap 55, bottom flap 65 and back wall bottom panel 60 can be molded to generic shapes so as to carry any item that may be of similar geometry or they can be molded to specific shapes so as to carry a specific item. Such items include but are not limited to: rifle magazines (as shown in FIG. 1), pistol magazines, ammunition, radios, flashlights, batons, handcuffs, flash bangs, hand grenades, batteries, scopes or other aiming devices, or any and all items as may be considered useful in a tactical situation or environment.

Additionally, a plurality of molding mounting apertures 110 in or on the front wall 10 and/or back wall 20 enhance the scope and usefulness of the invention enabling it to be completely modular, useable with an entire family of mounting accessories. Such accessories include but are not limited to: paddles, clips, belt loops, MOLLE (modular, lightweight load-carrying equipment) attachment devices, leg mounts, vest carry, harness carry, etc. Further the molded mounting apertures 110 allow stacking and attaching and fastening together of identical or similar pouches, organized in various combinations so as to be adaptable to the user's mission, operational environment, needs, training and or preference.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An expandable carry pouch defining an interior compartment defined by a. a front wall with an interior and exterior surface with apertures along a perimeter of the front wall;

b. a back wall opposed to the front wall with an interior and exterior surface with apertures along a perimeter of the back wall;

c. a pair of opposing side walls;

d. at least one covered recessed vertical channel molded into the interior surface of the front or back wall between the apertures along the perimeter of the front or back wall extending longitudinally along the length of the front or back wall with openings on opposite ends and molded into the front wall or back wall; and e. a top open end;

wherein the front wall and back wall are compressed towards one another using a binding device weaved or laced through the apertures in the perimeter of the front and back wall and the recessed vertical channel and the openings of the vertical channel.

2. The pouch of claim 1 further comprising molded mounting apertures on the exterior surface of at least one of the front wall and back walls.

3. The pouch of claim 2 wherein the mounting apertures are sized and dimensioned to attach to a mounting accessory.

4. The pouch of claim 3 wherein the mounting accessory is selected from the group comprising paddles; clips; belt loops; modular, lightweight load-carrying equipment attachment devices; leg mounts; vest carry devices and harness carry devices.

5. The pouch of claim 1 wherein the interior compartment is sized and dimensioned to carry tactical gear.

6. The pouch of claim 5 wherein the tactical gear is selected from the group comprising pistol magazine, ammunition, radio, flashlight, baton, handcuff, flash bang, hand grenade, batteries, scopes or aiming devices.

7. An expandable carry pouch defining an interior compartment defined by a. a front wall with an interior and exterior surface with apertures along a perimeter of the front wall;

b. a back wall opposed to the front wall with an interior and exterior surface with apertures along a perimeter of the back wall;

c. a pair of opposing side walls;

d. at least one covered recessed horizontal channel molded into the interior surface of the front or back wall between the apertures along the perimeter of the front or back wall extending crosswise along the length of the front or back wall with openings on opposite ends and molded into the front wall or back wall; and e. a top open end;

wherein the front wall and back wall are compressed towards one another using a binding device weaved or laced through the apertures in the perimeter of the front and back wall and the recessed horizontal channel and the and the openings of the horizontal channel.

8. The pouch of claim 7 further comprising molded mounting apertures on the exterior surface of at least one of the front wall and back wall.

9. The pouch of claim 8 wherein the mounting apertures are sized and dimensioned to attach to a mounting accessory.

10. The pouch of claim 9 wherein the mounting accessory is selected from the group comprising paddles; clips; belt loops; modular, lightweight load-carrying equipment attachment devices; leg mounts; vest carry devices and harness carry devices.

11. The pouch of claim 7 wherein the interior compartment is sized and dimensioned to carry tactical gear.

12. The pouch of claim 11 wherein the tactical gear is selected from the group comprising pistol magazine, ammunition, radio, flashlight, baton, handcuff, flash bang, hand grenade, batteries, scopes or aiming devices.

* * * * *